United States Patent [19]

Shirley

[11] Patent Number: 4,534,553

[45] Date of Patent: Aug. 13, 1985

[54] EXERCISE APPARATUS

[76] Inventor: Steven E. Shirley, P.O. Box 54, Scottsburg, Ind. 47170

[21] Appl. No.: 415,357

[22] Filed: Sep. 7, 1982

[51] Int. Cl.[3] ..... A63B 23/02; A63B 23/04

[52] U.S. Cl. ..... 272/73; 272/127; 272/134

[58] Field of Search ..... 272/73, 126, 127, 134; 128/25 R; 272/53.1; 128/33, 24.2, 48, 51, 54, 70, 34

[56] References Cited

U.S. PATENT DOCUMENTS

| | | | |
|---|---|---|---|
| 1,143,981 | 6/1915 | Macklin | 128/70 |
| 1,482,173 | 1/1924 | Willard | 128/70 |
| 1,686,979 | 10/1928 | McManis | 128/25 R UX |
| 2,009,730 | 7/1935 | Fisher | 128/33 |
| 2,320,489 | 6/1943 | Turner et al. | 128/25 R |
| 2,494,746 | 1/1950 | Colston | 128/25 R UX |
| 2,498,047 | 2/1950 | Myers | 272/73 X |
| 3,112,108 | 11/1963 | Hanke | 272/73 X |
| 3,432,164 | 3/1969 | Deeks | 272/73 |
| 3,880,153 | 4/1975 | Perrine | 128/52 |
| 4,036,219 | 7/1977 | Simjian | 128/48 |

FOREIGN PATENT DOCUMENTS

| | | | |
|---|---|---|---|
| 342351 | 7/1904 | France | 272/73 |

*Primary Examiner*—Robert A. Hafer
*Assistant Examiner*—Arnold W. Kramer
*Attorney, Agent, or Firm*—Woodard, Weikart, Emhardt & Naughton

[57] ABSTRACT

The pedalling action drives a drive axle which is positioned below the back support. A wheel is eccentrically positioned on the drive axle and acts as a cam to drive the back support in its repeated pivoting motion. Roller bearings are positioned on the underneath side of the back support and engage the eccentric wheel (cam), thereby reducing friction between the rotating wheel and the pivoting back support during the sit up cycle.

7 Claims, 3 Drawing Figures

EXERCISE APPARATUS

BACKGROUND OF THE INVENTION

1. Field of the Invention

This invention relates to exercising devices.

2. Brief Description of the Prior Art

A wide variety of exercise devices have been developed for body conditioning, entertainment, and sometimes for medical purposes. U.S. Pat. No. 3,432,164 to Deeks is one such example of a unique exercise device which simulates the effect of horseback riding. U.S. Pat. No. 1,796,682 to Bell discloses another unique exercising device in which a rocking motion generated by a person mounted on the apparatus causes the apparatus to be propelled, as in the manner of a vehicle. Alternately, the rocking motion can be used as a stationary exercising device. U.S. Pat. No. 2,484,153 to Chaudoir discloses an exercising device which enables bedridden patients to perform a pedalling exercise while lying in bed. The prior art has generally not disclosed exercise devices which utilize a pedalling action by the exerciser to operate a "sit up" cycle, thereby causing the pedalling exerciser to also benefit from a repeated sit up exercise.

SUMMARY OF THE INVENTION

Generally, the present invention relates to an exercise apparatus in which pedalling motion by a person positioned on the apparatus causes a back support to periodically pivot, thereby simultaneously aiding the exerciser in the performing of sit ups. In one embodiment, the pedalling action drives a drive axle which is positioned below the back support. A wheel is eccentrically positioned on the drive axle and acts as a cam to drive the back support in its repeated pivoting motion. Roller bearings are positioned on the underneath side of the back support and engage the eccentric wheel (cam), thereby reducing friction between the rotating wheel and the pivoting back support during the sit up cycle.

Accordingly, it is an object of the present invention to provide an exercise apparatus by which exercising motion of the legs can be utilized to assist in the performance of sit up exercises.

It is a further object of the present invention to provide an exercise apparatus which simultaneously exercises the legs, thighs, buttocks, abdominal and lower back muscles.

It is another object of the present invention to provide an exercise apparatus which enables sit ups to be performed by those which would not otherwise be able to do that exercise.

These and other objects and advantages of the present invention will become apparent from the following disclosure.

DESCRIPTION OF THE PREFERRED EMBODIMENT

Figure 1:
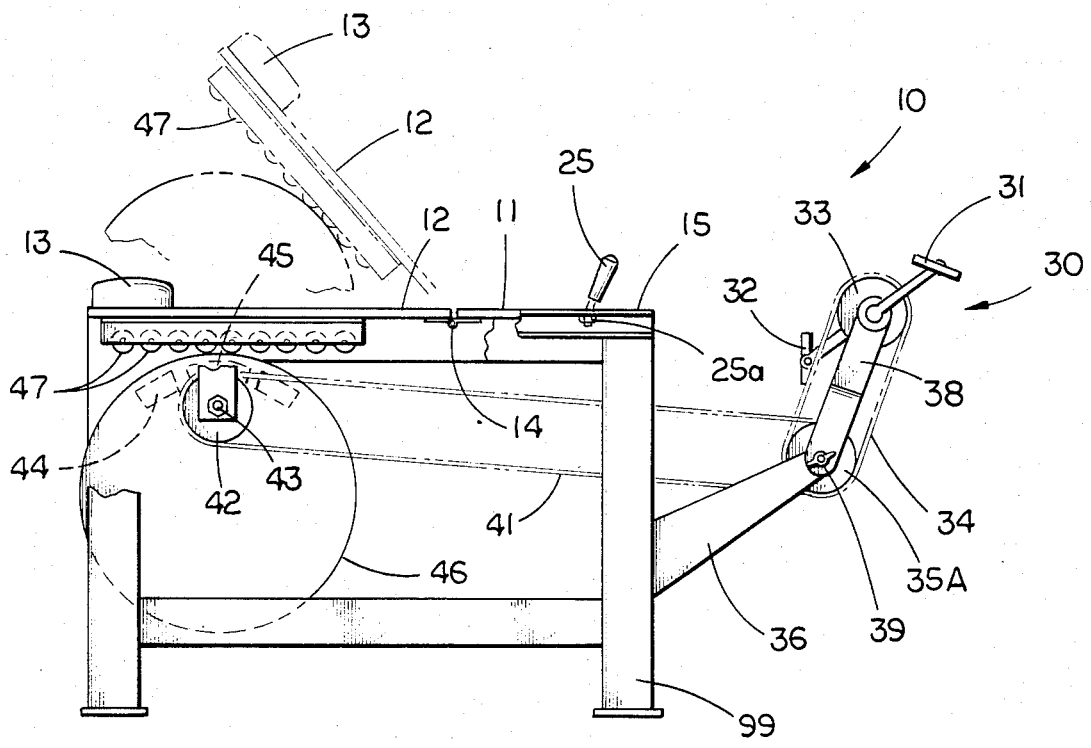
FIG. 1 is a side elevational view of the preferred embodiment, with the raised or "sit up" position being shown in dashed format.
Figure 2:
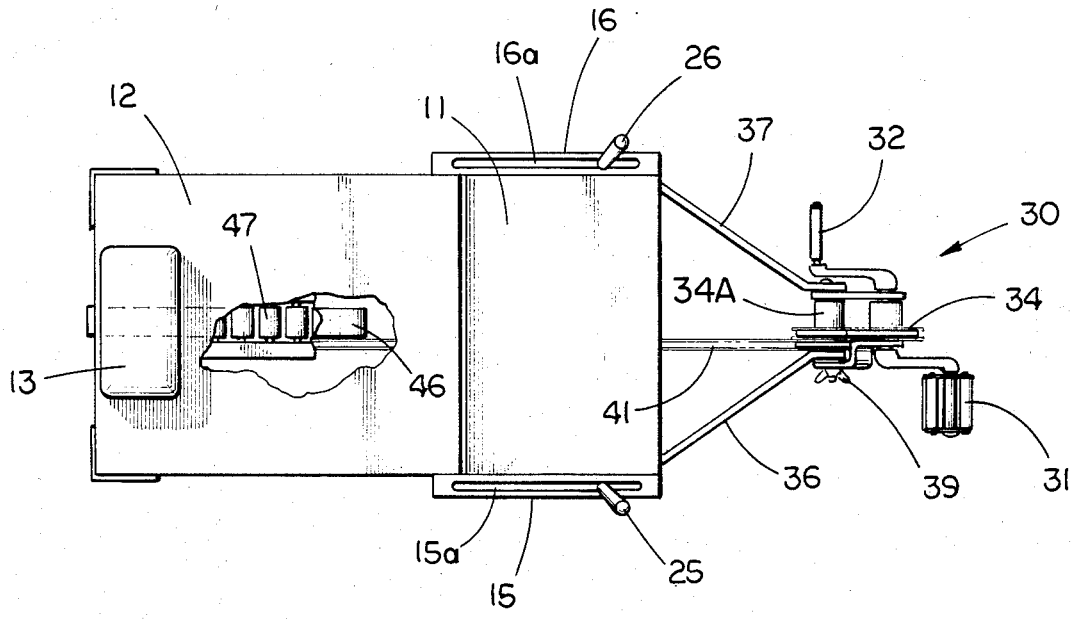
FIG. 2 is a top plan view of the exercise apparatus of FIG. 1.
Figure 3:
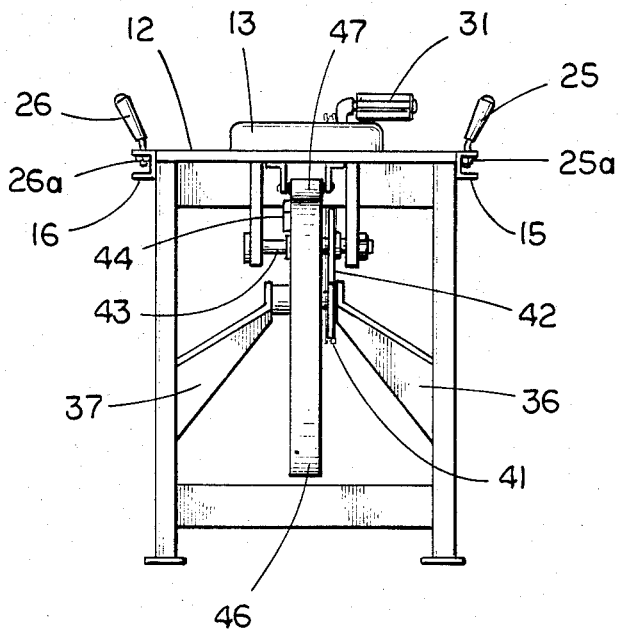
FIG. 3 is a rear plan view of the exercise apparatus of FIGS. 1 and 2.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings, the exercise device 10 of the preferred embodiment includes a frame 99 upon which is mounted a seat support 11 suitable for supporting the buttocks of a person. Pivotally mounted to frame 99 at hinge 14 is back support 12 which includes head rest 13. Also mounted to frame 99 along the sides of seat support 11 are tracks 15 and 16. Tracks 15 and 16 define channels 15A and 16A respectively, along which are adjustably mounted handles 25 and 26. The positioning of handles 25 and 26 along channels 15A and 16A respectively may be selectively adjusted by loosening and tightening nuts 25A and 26A respectively.

Pedal mechanism 30 includes pedal arms 31 and 32 oppositely mounted to sprocket wheel 33. Pedal mechanism 30 is adjustably mounted to support shaft 38 by means of support member 34A. Support shaft 38 is mounted to frame 99 by means of support members 36 and 37. Rotatably mounted to support shaft 38 are sprocket wheels 33 and 35A. Sprocket wheel 35A is drivingly engaged to sprocket wheel 33 by means of chain 34. Sprocket wheel 35A is drivingly engaged to sprocket wheel 42 by means of chain 41. By loosening and tightening wing nut 39, the relative position of pedal mechanism 30 to frame 99 may be adjusted. Sprocket wheel 42 is mounted to drive axle 43. Drive axle 43 is rotatably mounted to downwardly extending members 45. Eccentrically mounted to drive axle 43 and rotatable therewith is cam wheel 46. Cooperating wheel bearings 47, which are attached to the underside of back support 12, engage cam wheel 46. Weights 44 are positioned on wheel 46 about its circumference portion that is in proximity with axle 43.

In operation, a person is positioned on frame 99, with his buttocks resting upon seat support 11 and his back resting upon back support 12. Handles 25 and 26 are adjusted for the individual comfort of the exerciser. Also, pedal mechanism 30 is adjusted to accommodate a comfortable pedalling position for the exerciser positioned on frame 99. This is done by means of loosening and tightening wing nut 39 and pivoting pedalling mechanism 32 to or away from seat support 11 to a suitable position. To exercise, a person positioned on frame 99 pedals pedalling mechanism 30. The pedal action drives sprocket 33 which chain drives sprocket 35A. In turn, the rotation of sprocket wheel 35A drives sprocket wheel 42 by chain linkage 41. Drive shaft 43 is thereby rotatably driven, in turn driving cam wheel 46. The resulting motion of cam wheel 46 causes back support 12 to cyclically pivot between horizontal and raised positions, thereby assisting the exerciser in the performance of sit ups as he is simultaneously doing his pedal exercise. Wheel bearings 47 engage with cam wheel 46, reducing friction between these members and allowing freer movement during the sit up cycles. Weights 44 act to counterbalance the weight distribution of wheel 46 about axle 43, thereby equilibrating resistive and inertial forces upon said cam means over the period of rotation.

While it has been described above the principles of this invention in connection with specific apparatus, it is to be clearly understood that this description is made only by way of an example and not as a limitation to the scope of the invention.

What is claimed:

1. An exercise apparatus for aiding the performance of multiple, simultaneous exercises, said apparatus comprising:

a frame;

seat support means for supporting the buttocks of a person on said frame;

back support means for supporting the back portion of a person on said frame, said back support means being pivotally mounted in relation to said seat support means;

pedal means for pedalling by a person positioned on said seat support means and said back support means;

a drive axle, said drive axle being mounted to said frame below said back support means;

drive means for translating the pedalling action of said pedalling means to rotation of said drive axle;

a cam mounted to said drive axle and rotatable therewith, said cam engaging and supporting said back support means, said cam and said back support means being cooperatingly shaped such that rotation of said cam, caused by pedalling of said pedalling means, causes said back support means to cyclically pivot.

2. The exercise apparatus of claim 1 additionally including means for equilibrating resistive and inertial forces upon said cam means over the period of rotation.

3. The exercise apparatus of claim 2 in which said equilibrating means includes means for balancing the weight distribution of said cam means.

4. The exercise apparatus of claim 1 in which said cam means includes a circular member eccentrically mounted about said drive axle.

5. An exercise apparatus for aiding the performance of multiple, simultaneous exercises, said apparatus comprising:

a frame;

seat support means for supporting the buttocks of a person on said frame;

back support means for supporting the back portion of a person on said frame, said back support means being pivotally mounted in relation to said seat support means;

pedal means for pedalling by a person positioned on said seat support means and said back support means;

a drive axle, said drive axle being mounted to said frame below said back support means;

drive means for translating the pedalling action of said pedalling means to rotation of said drive axle;

translation means for translating the rotation of said drive axle to a cyclical pivoting action of said back support means between a horizontally positioned lowered position and an angularly positioned raised position.

6. The exercise apparatus of claim 5 in which said translation means includes means for equilibrating resistive and inertial forces over the period of cyclical pivoting of said back support means.

7. The exercise apparatus of claim 6 in which said translation means includes a cam mounted to said drive axle and rotatable therewith, said cam engaging and supporting said back support means, said cam and said back support means being cooperatingly shaped such that rotation of said cam, caused by pedalling of said pedalling means, causes said back support means to cyclically pivot.

* * * * *